US008109120B2

(12) United States Patent
Ahn et al.

(10) Patent No.: US 8,109,120 B2
(45) **Date of Patent: *Feb. 7, 2012**

(54) STEAM GENERATING DEVICE AND WASHING MACHINE HAVING THE SAME

(75) Inventors: In Geun Ahn, Changwon-si (KR); Kyu Won Lee, Busan (KR); Seong Il Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 613 days.

This patent is subject to a terminal disclaimer.

(21) Appl. No.: 11/819,320

(22) Filed: Jun. 26, 2007

(65) Prior Publication Data

US 2008/0006063 A1 Jan. 10, 2008

(30) Foreign Application Priority Data

Jun. 27, 2006 (KR) ..... 10-2006-0058061

(51) Int. Cl.
*D06F 39/04* (2006.01)

(52) U.S. Cl. ..... 68/15; 68/207

(58) Field of Classification Search ..... 68/5 R, 68/12.05, 12.21, 15, 207
See application file for complete search history.

(56) References Cited

U.S. PATENT DOCUMENTS

| | | | | |
|---|---|---|---|---|
| 7,765,628 | B2 * | 8/2010 | Wong et al. | 8/158 |
| 2005/0034249 | A1 * | 2/2005 | Oh et al. | 8/159 |
| 2005/0034250 | A1 * | 2/2005 | Oh et al. | 8/159 |
| 2005/0034487 | A1 * | 2/2005 | Oh et al. | 68/5 C |
| 2005/0034489 | A1 * | 2/2005 | Oh et al. | 68/5 C |
| 2006/0010937 | A1 * | 1/2006 | Kim et al. | 68/12.05 |
| 2006/0016020 | A1 * | 1/2006 | Park | 8/158 |
| 2007/0283505 | A1 * | 12/2007 | Wong et al. | 8/149.3 |
| 2007/0283728 | A1 * | 12/2007 | Wong et al. | 68/5 R |

FOREIGN PATENT DOCUMENTS

| | | | |
|---|---|---|---|
| EP | 1464750 | A1 | 1/2004 |
| EP | 1813704 | A1 | 1/2004 |
| KR | 1020050108788 | A * | 11/2005 |

OTHER PUBLICATIONS

Electronic translation of KR1020050108788A, date not applicable.*

* cited by examiner

*Primary Examiner* — Joseph L Perrin
(74) *Attorney, Agent, or Firm* — McKenna Long & Aldridge LLP

(57) ABSTRACT

A steam generating device and a washing machine having the same are disclosed. The steam generating device includes a lower housing including a main portion for receiving a heater, and connecting portions extending outwardly from the main portion, the lower housing defining a water chamber for containing water, an upper housing connected to the connecting portions, the upper housing defining a steam chamber for containing steam, a water level sensor for sensing a level of water contained in the water chamber, and a receptacle for protecting the water level sensor. The receptacle has an opening for allowing water to be introduced into the receptacle, and is substantially aligned with an inner surface of the lower housing or is arranged at a position spaced apart from the heater by a longer distance than the inner surface of the lower housing.

21 Claims, 9 Drawing Sheets

STEAM GENERATING DEVICE AND WASHING MACHINE HAVING THE SAME

This application claims the benefit of Korean Patent Application No. 10-2006-0058061, filed on Jun. 27, 2006, which is hereby incorporated by reference as if fully set forth herein.

BACKGROUND OF THE INVENTION

1. Field of the Invention

The present invention relates to a washing machine, and more particularly to a steam generating device, which generates steam to be supplied to a washing machine, and a washing machine having the steam generating device.

2. Discussion of the Related Art

Generally, washing machines are classified into a pulsator type, in which a washing operation is carried out using a flow of water generated in accordance with the rotation of a pulsator, and a drum type, in which a washing operation is carried out using the heads of wash water and laundry falling down in a horizontally-installed drum and frictional force generated between the drum and the laundry during rotation of the drum.

Recently, a washing machine, which has a function capable of washing laundry using steam, has been proposed. When steam is used in a washing operation, as in such a washing machine, it is possible to reduce the consumption of water and electricity, to achieve an enhancement in washing performance, to remove creases and odor, and to prevent generation of static electricity.

A drum washing machine, which performs a washing operation, etc., using steam, will be described hereinafter with reference to FIG. 1.

The drum washing machine includes a cabinet 10 forming an appearance of the washing machine, a cylindrical tub 20 horizontally supported by the cabinet 10 in the interior of the cabinet 10, to store wash water, a drum 30 rotatably installed in the tub 20, and a drive motor (not shown) for driving the drum 30. An inlet 13 is formed at a front side of the cabinet 10. The inlet 13 communicates with the interior of the drum 30 so that laundry can be put into or taken out of the drum 30 through the inlet 13. A door 11 is mounted to the inlet 13, to open or close the inlet 13. Water supply valves 15 are provided at one side of the drum washing machine. The water supply valves 15 are connected to external water pipes (not shown), respectively, so as to supply water to the tub 20. The water valves 15 are connected to a detergent box 27 via a hot water pipe 25*a* and a cold water pipe 26, respectively.

The drum washing machine also includes a steam generating device 50 for supplying steam to the drum 30. A water supply hose 25 and a steam hose 53 are connected to the steam generating device 50. The water supply hose 25 supplies water to the steam generating device 50, whereas the steam hose 53 supplies steam generated from the steam generating device 50 to the drum 30. Typically, the water supply hose 25 is connected to a hot water side of the water supply valve 15. The steam hose 53 has an end preferably having a nozzle shape, so as to effectively spray steam into the drum 30. Preferably, the steam hose 53 is installed such that the nozzle-shaped end thereof, from which steam is discharged, is exposed to the interior of the tub 20.

The configuration of the steam generating device 50 will be described in more detail with reference to FIGS. 2 and 3.

The steam generating device 50 includes a case 80. The case 80 includes a lower housing 81 forming an appearance of the steam generating device 50 and an upper housing 82 coupled to an upper end of the lower housing 81. A space for storing water is defined in the lower housing 81. The steam generating device 50 also includes a heater 55 for heating water stored in the case 80.

A water supply port 52*b* is formed at one side of the housing 82. The water supply port 52*b* is connected to the water supply hose 25, to introduce water from the water support hose 25 into the steam generating device 50. A steam discharge port 52*a* is formed at the other side of the housing 82. The steam discharge port 52*a* is connected to the steam hose 53, to supply steam from the steam hose 53 to the drum 20.

The heater 55 is installed on the bottom of the upper housing 82 such that it is completely submerged under water when water is introduced into the steam generating device 50. Thus, the heater 55 operates in a state of being submerged under water. To this end, a water level sensor 60 is installed at one side of the upper housing 82, to sense a water level of the steam generating device. Since the water level sensor 60 measures the level of water stored in the steam generating device 50, the amount of water stored in the steam generating device can be maintained at an appropriate level. That is, when the water level of the steam generating device 50 is lower than a first reference value (low water level), the water supply valve 15 is opened to supplement water. On the other hand, when the water level of the steam generating device 50 reaches a second reference (high water level), the water supply valve 15 is closed. In this case, the heater 55 operates to generate steam.

A temperature sensor 57 is also installed to measure the temperature of water heated by the heater 55 and the temperature of steam generated in accordance with the heating operation of the heater 55. The temperature sensor 57 measures the internal temperature of the steam generating device, in order to cut off the supply of electricity to the heater 55 when the measured temperature is higher than a reference value, and thus to prevent the heater 55 from being over-heated.

Hereinafter, the water level sensor 60 will be described in detail.

The water level sensor 60 includes a receptacle housing 61 forming an appearance of the water level sensor 60. The receptacle housing 61 is fixedly mounted to the steam generating device 50. The water level sensor 60 also includes electrodes arranged in the receptacle housing 61 such that they extend downwardly, to sense the level of water stored in the steam generating device 50. The electrodes 62, 63, and 64 are positioned at predetermined levels from the bottom of the lower housing 81, in order to sense the level of water stored in the steam generating device 50. The electrodes comprise at least a common electrode 62 functioning as a reference electrode for sensing a water level, a low-water-level electrode 63 for sensing a low water level, and a high-water-level electrode 64 for sensing a high water level. The common electrode 62 preferably has a length equal to or longer than the length of the low-water-level electrode 63.

Meanwhile, there is a possibility that, when water supplied through the water supply port 52*b* is splashed, and attached to the electrodes 62, 63, and 64, the water level sensor 60 may malfunction. Furthermore, it is difficult to completely prevent generation of vibration during operation of the washing machine. For this reason, the steam generating device 50 may also vibrate during operation of the washing machine, so that the water stored in the steam generating device 50 may roll.

Due to the above-mentioned factors, the water level sensor 60 may malfunctions. In order to prevent the water level sensor 60 from malfunctioning, a receptacle 70 is provided. The receptacle 70 is configured to enclose the electrodes 62, 63, and 64, and to have an open bottom. The receptacle 70 also preferably has an opening 70*s*.

However, the above-mentioned conventional steam generating device and the washing machine equipped with the same have the following problems.

Since the conventional steam generating device has a substantially rectangular shape having a small height L1 and a large width L2, as shown in FIG. 4, it is difficult to install the steam generating device 50 in the washing machine. This is because, although the steam generating device 50 is typically installed in an upper portion of the washing machine, in detail, in a space defined between the cabinet 10 and the tub 20, the space between the tub 20 and the steam generating device 50 is relatively small.

In the space defined between the cabinet 10 and tub 20, a valve, hanging springs, etc. are also installed. For this reason, the space for installing the steam generating device 50 may be insufficient. As a result, it is difficult to install and repair the steam generating device 50.

Furthermore, although the steam generating device 50 is in an installed state, the steam generating device 50 may interfere with other elements of the washing machine when the washing machine is moved because the spacing t between the steam generating device 50 and the tub 20. As a result, the steam generating device 50 may be damaged. Since the spacing t between the steam generating device 50 and the tub 20 is relatively small, they may strike against each other due to vibrations generated during operation of the washing machine. As a result, the steam generating device 50 may be damaged.

In addition, it is required to enhance the performance of the steam generating device 50, for example, the amount of water used, energy efficiency, steam generating time, security, etc.

Meanwhile, when water boils in accordance with the operation of the steam generating device 50, air bubbles are abruptly generated. The generated air bubbles may be attached to the electrodes 62, 63, and 64, thereby causing the water level sensor 60 to malfunction.

SUMMARY OF THE INVENTION

Accordingly, the present invention is directed to a steam generating device and a washing machine having the same that substantially obviate one or more problems due to limitations and disadvantages of the related art.

An object of the present invention is to provide a steam generating device, which can be more easily installed, and a washing machine having the steam generating device.

Another object of the present invention is to provide a steam generating device, which can enhance the performance thereof, and can enhance the performance of a washing machine, to which the steam generating device is applied, and a washing machine having the same.

Still another object of the present invention is to provide a steam generating device, which can prevent malfunction of a water level sensor included in the steam generating device, and a washing machine having the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a steam generating device comprises: a lower housing including a main portion for receiving a heater, and connecting portions extending outwardly from the main portion, the lower housing defining a water chamber for containing water; an upper housing connected to the connecting portions, the upper housing defining a steam chamber for containing steam; a water level sensor for sensing a level of water contained in the water chamber; and a receptacle for protecting the water level sensor, the receptacle including an opening for allowing water to be introduced into the receptacle, wherein the receptacle is spaced apart from the heater by a distance equal to or longer than a distance from the heater to an inner surface of the main portion.

Preferably, the water chamber has a vertical length relatively longer than a horizontal length of the water chamber. Preferably, the steam chamber has a horizontal length relatively longer than the horizontal length of the water chamber.

Preferably, the steam generating device further comprise a rib provided at an inner surface of the lower housing, to prevent air bubbles from flowing into the receptacle.

Preferably, the rib is protruded toward a bottom of the receptacle. More preferably, the rib is integrally formed at the inner surface of the lower housing.

The receptacle may include a long barrier wall arranged substantially in parallel to the water level sensor, and a pair of short barrier walls each having a first end connected to the long barrier wall and a second end connected to an inner wall surface of the upper housing.

Preferably, a first opening is formed at a lower end of the long barrier wall, and a second opening is formed at one side of each short barrier wall.

The long barrier wall defines an outer surface of the receptacle.

In this case, preferably, the steam generating device further comprises a rib provided at an inner surface of the lower housing, to prevent air bubbles from flowing inside the long barrier wall.

In this case, preferably, the rib is protruded toward the long barrier wall such that a first opening is defined between the rib and the long barrier wall. More preferably, the rib is integrally formed at the inner surface of the lower housing.

In another aspect of the present invention, a steam generating device comprises: a lower housing including a main portion for receiving a heater, and connecting portions extending outwardly from an end of the main portion, the lower housing defining a water chamber for containing water; an upper housing connected to the connecting portions, the upper housing defining a steam chamber for containing steam; a water level sensor arranged over one of the connecting portions, to sense a level of water contained in the water chamber; and a rib extending from the end of the main portion toward the upper housing.

In accordance with the above-described configuration, it is possible to easily install the steam generating device, to enhance the performances of the steam generating device and washing machine, and to effectively prevent air bubbles from being introduced into the receptacle.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

The present invention now will be described more fully hereinafter with reference to the accompanying figures, in which embodiments of the invention are shown. Wherever possible, the same reference numbers will be used throughout the drawings to refer to the same or like parts, and no repeated description thereof will be given.

Figure 1:
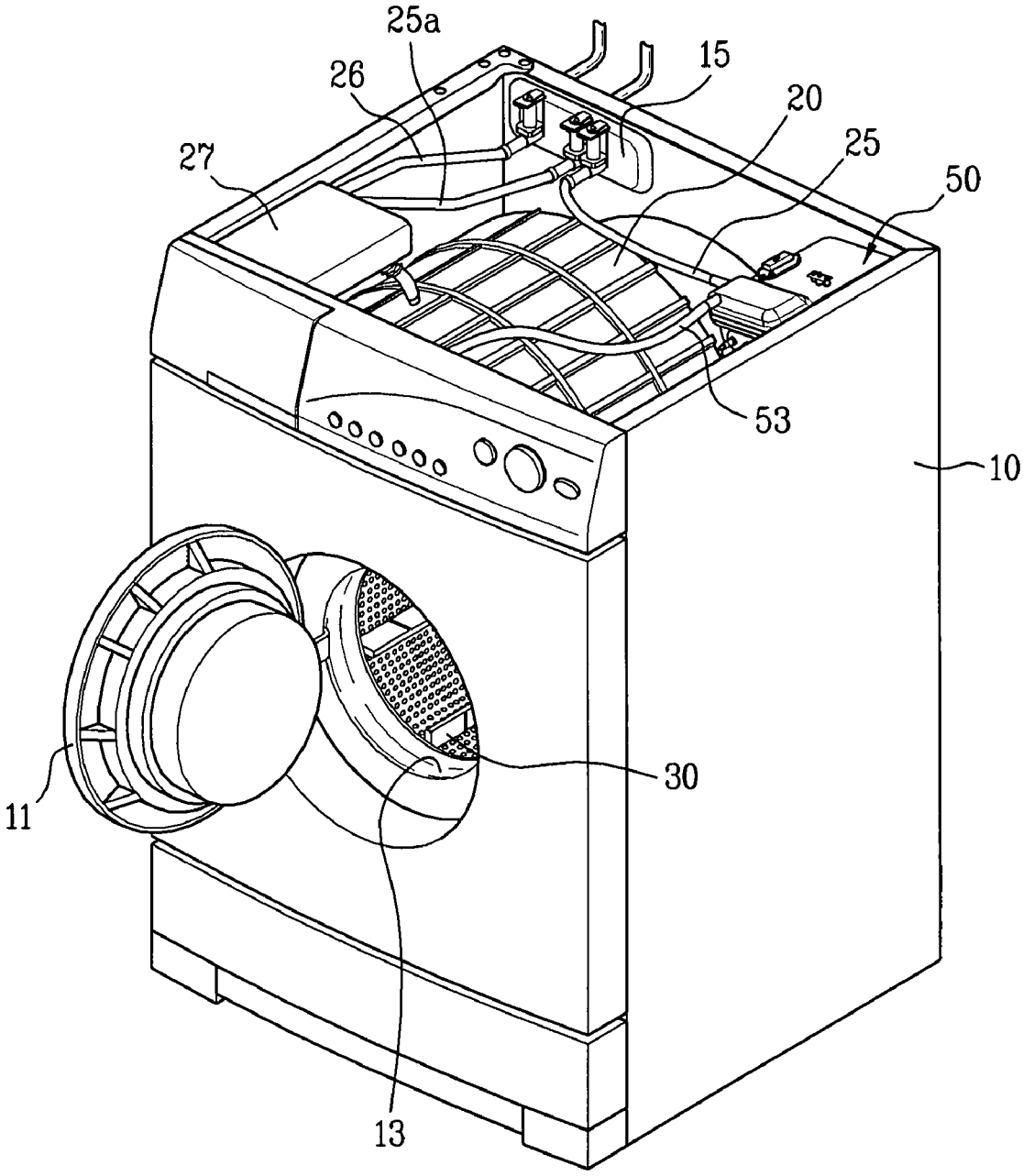
FIG. 1 Related Art
FIG. 1 is a perspective view illustrating a structure of a conventional drum washing machine.
Figure 2:
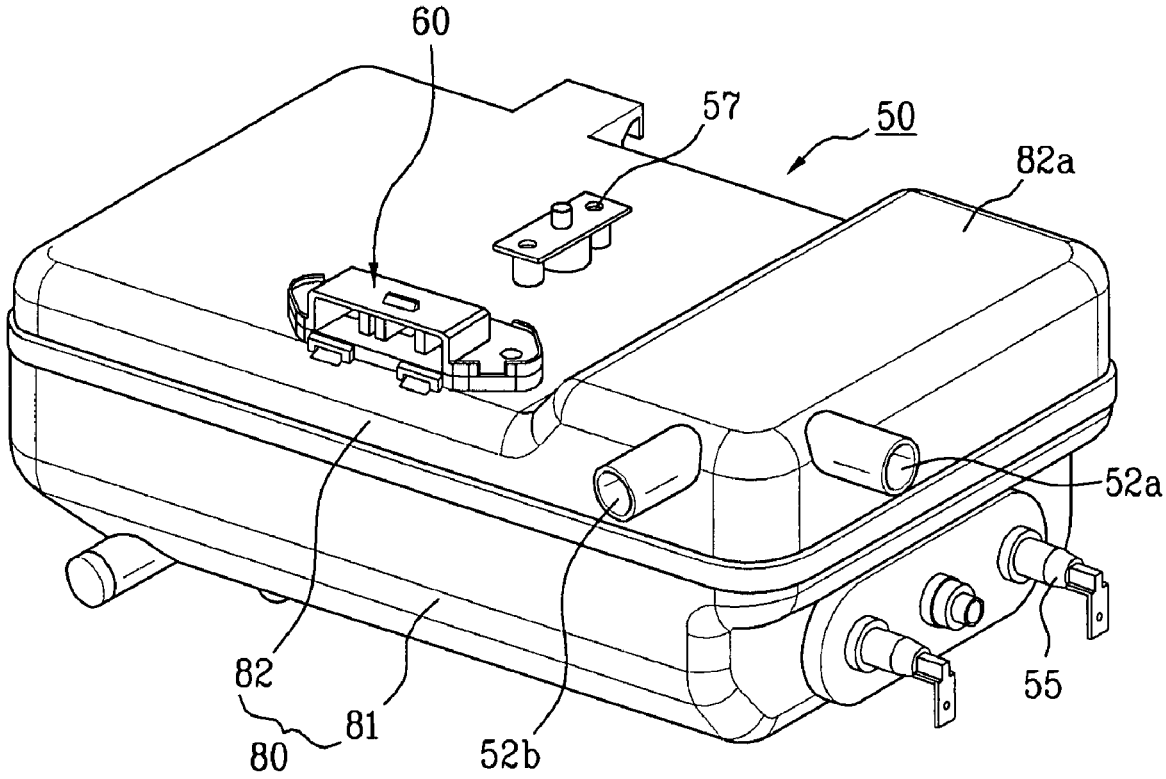
FIG. 2 Related Art
FIG. 2 is a perspective view illustrating the steam generating device of FIG. 1.
Figure 3:
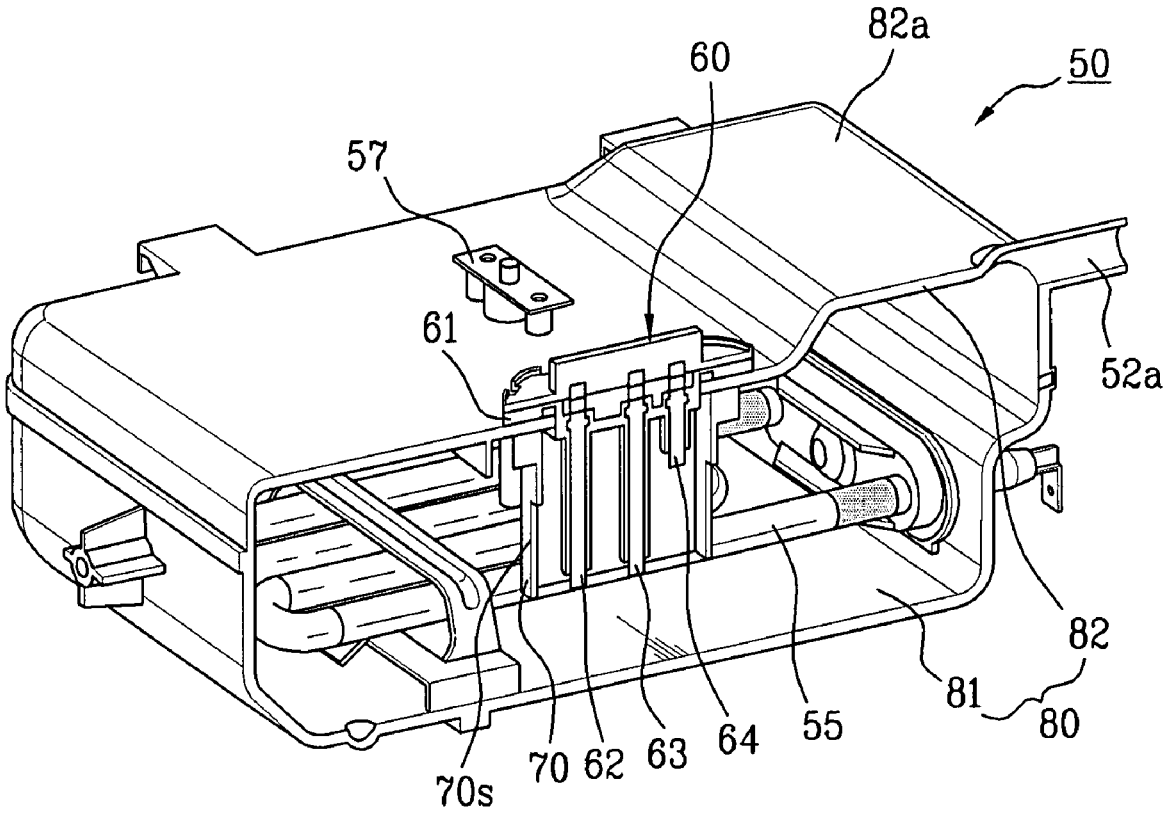
FIG. 3 Related Art
FIG. 3 is a partially-broken perspective view illustrating the steam generating device of FIG. 2.
Figure 4:
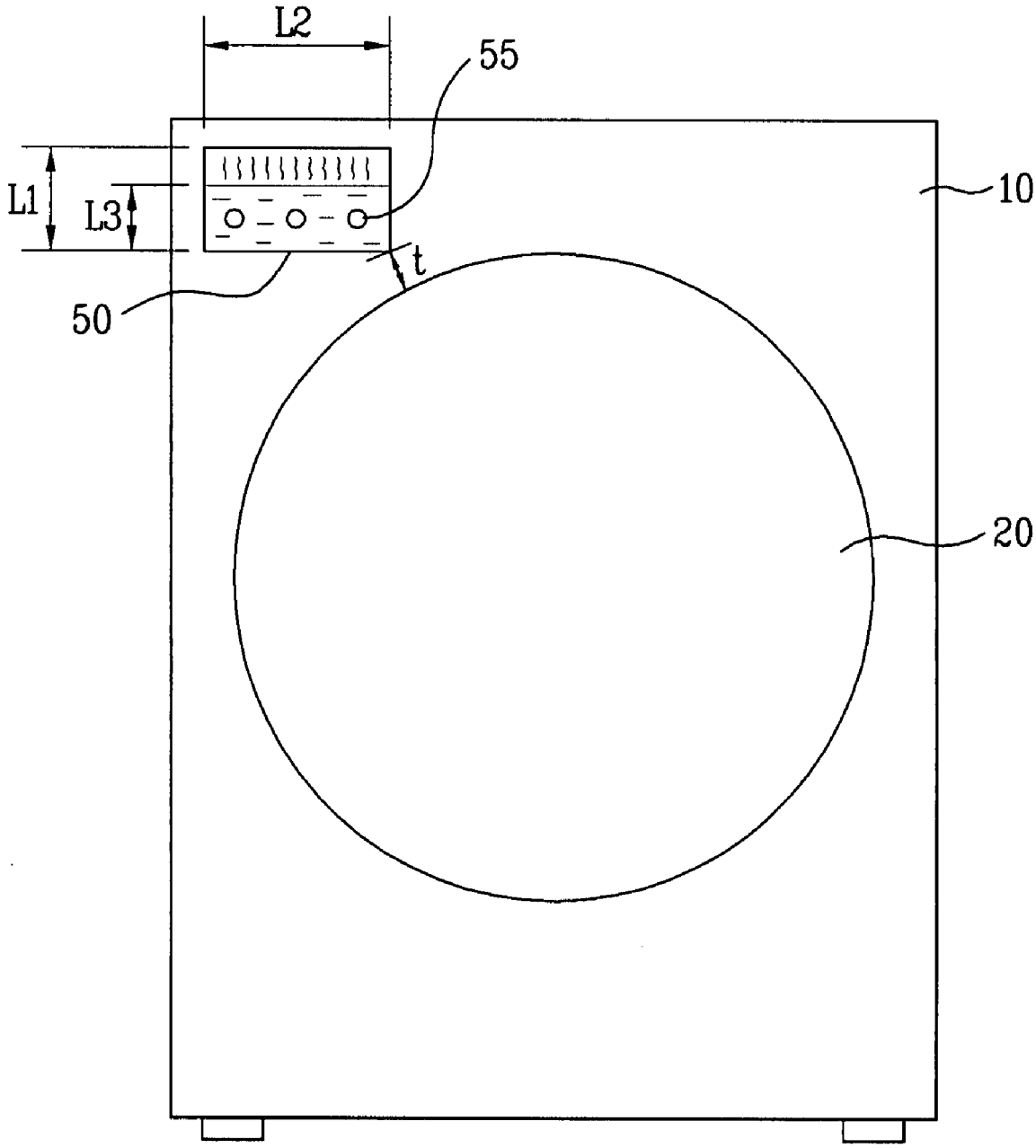
FIG. 4 Related Art
FIG. 4 is a schematic view for explaining an installation condition of the steam generating device shown in FIG. 1.
Figure 5:
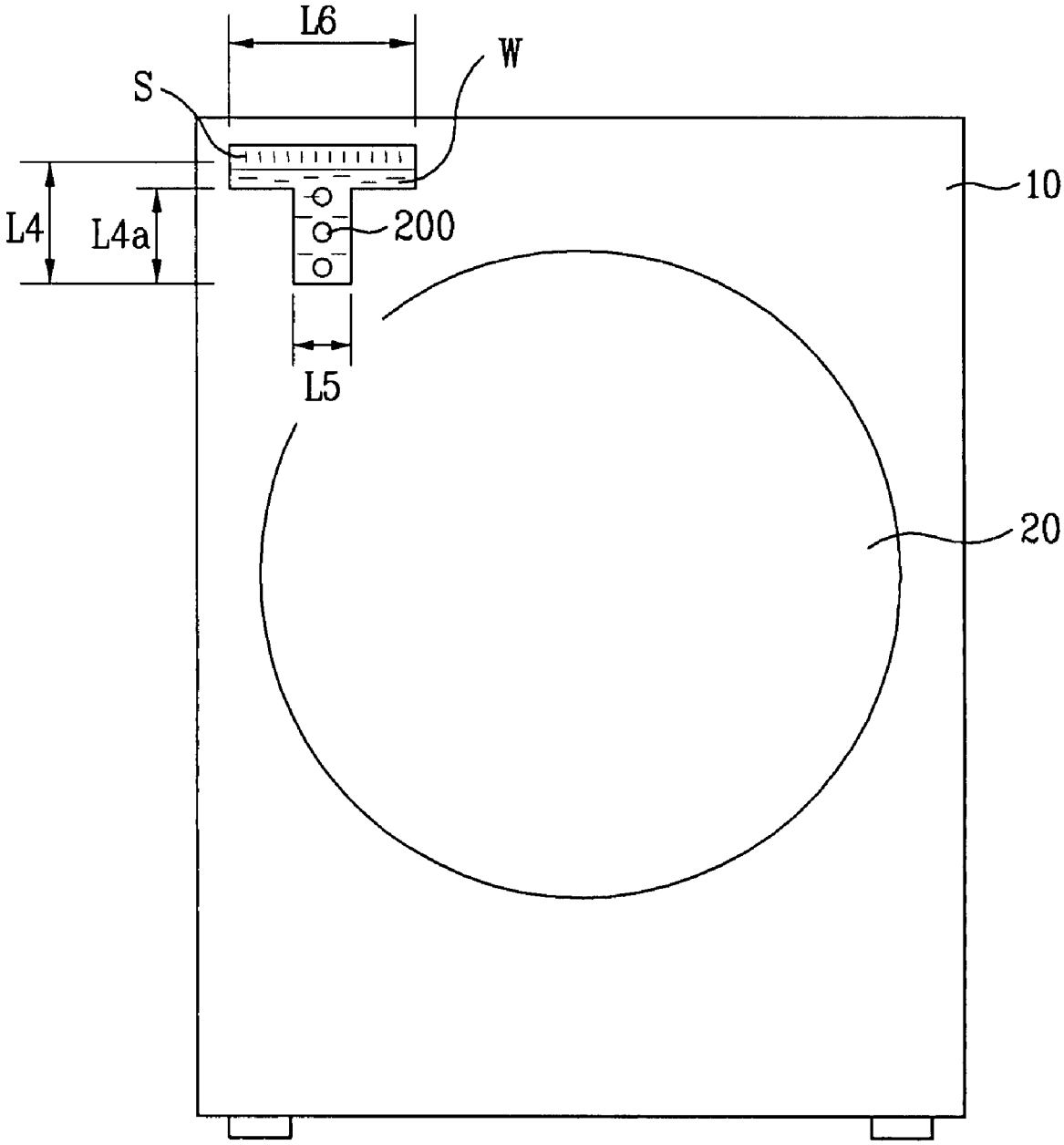
FIG. 5 is a schematic view for explaining the principle of a steam generating device according to the present invention, corresponding to FIG. 4.
Figure 6:
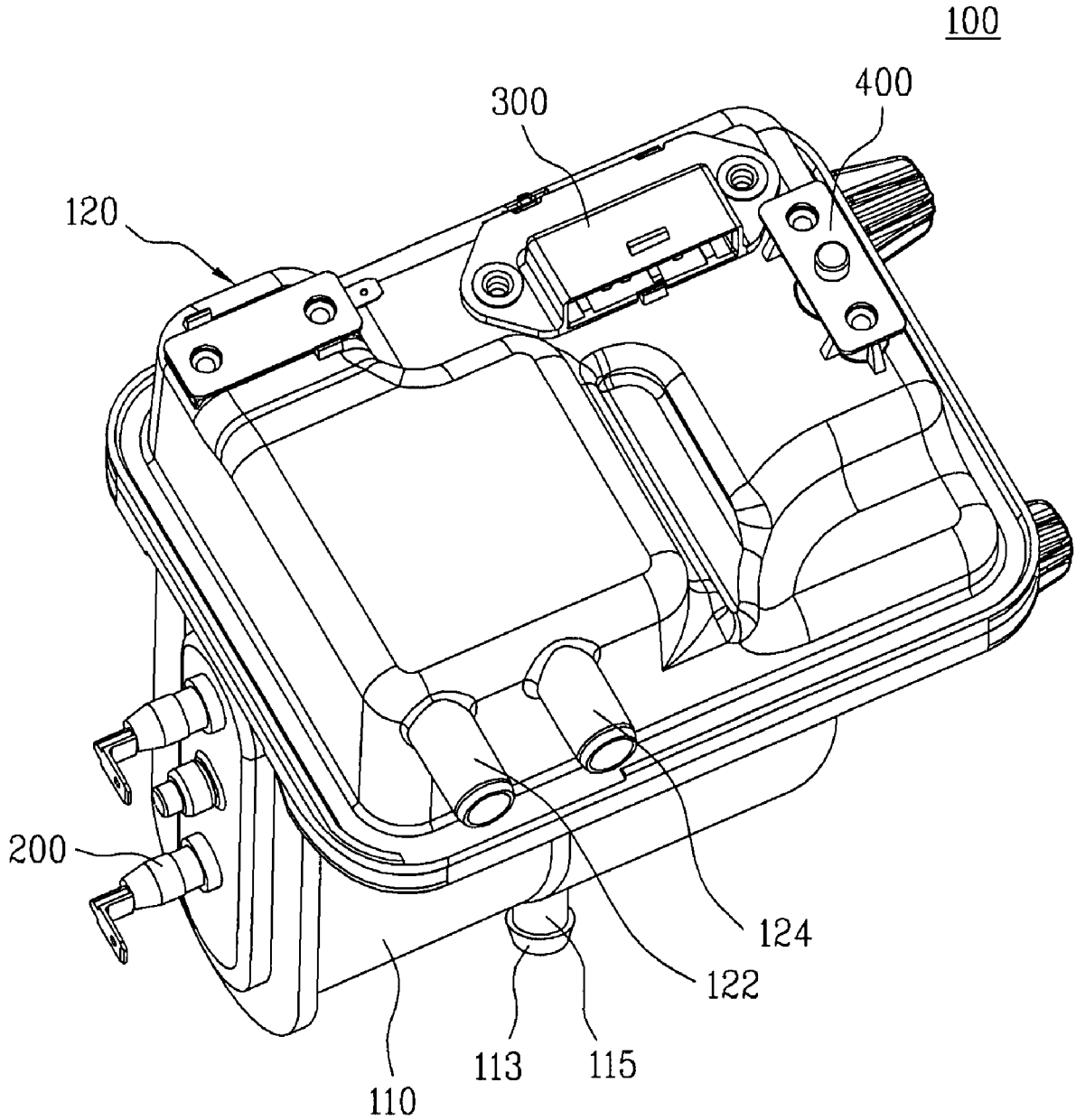
FIG. 6 is a perspective view illustrating a concrete embodiment of the steam generating device shown in FIG. 5.
Figure 7:
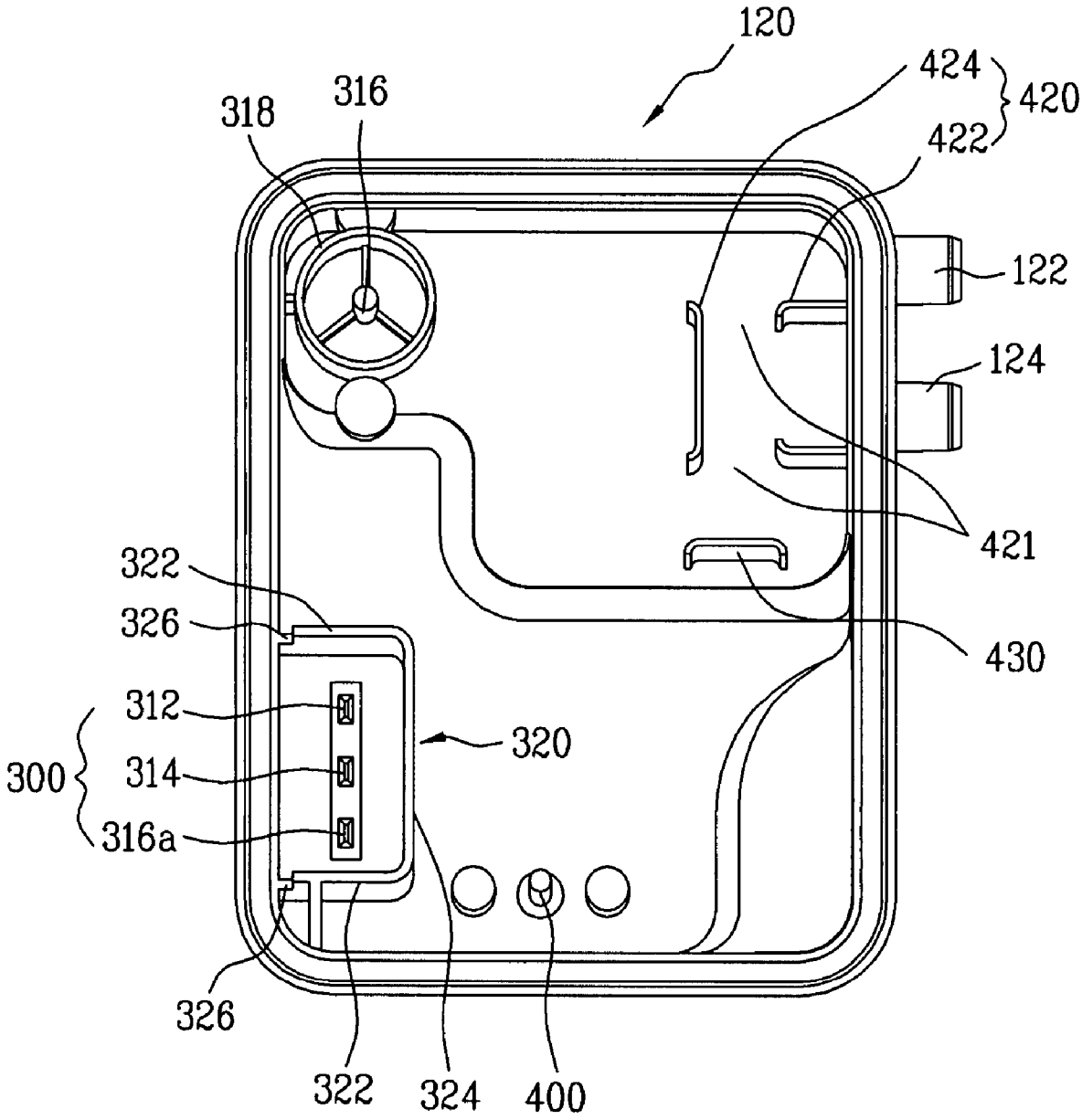
FIG. 7 is a bottom view illustrating an upper housing shown in FIG. 6.
Figure 8:
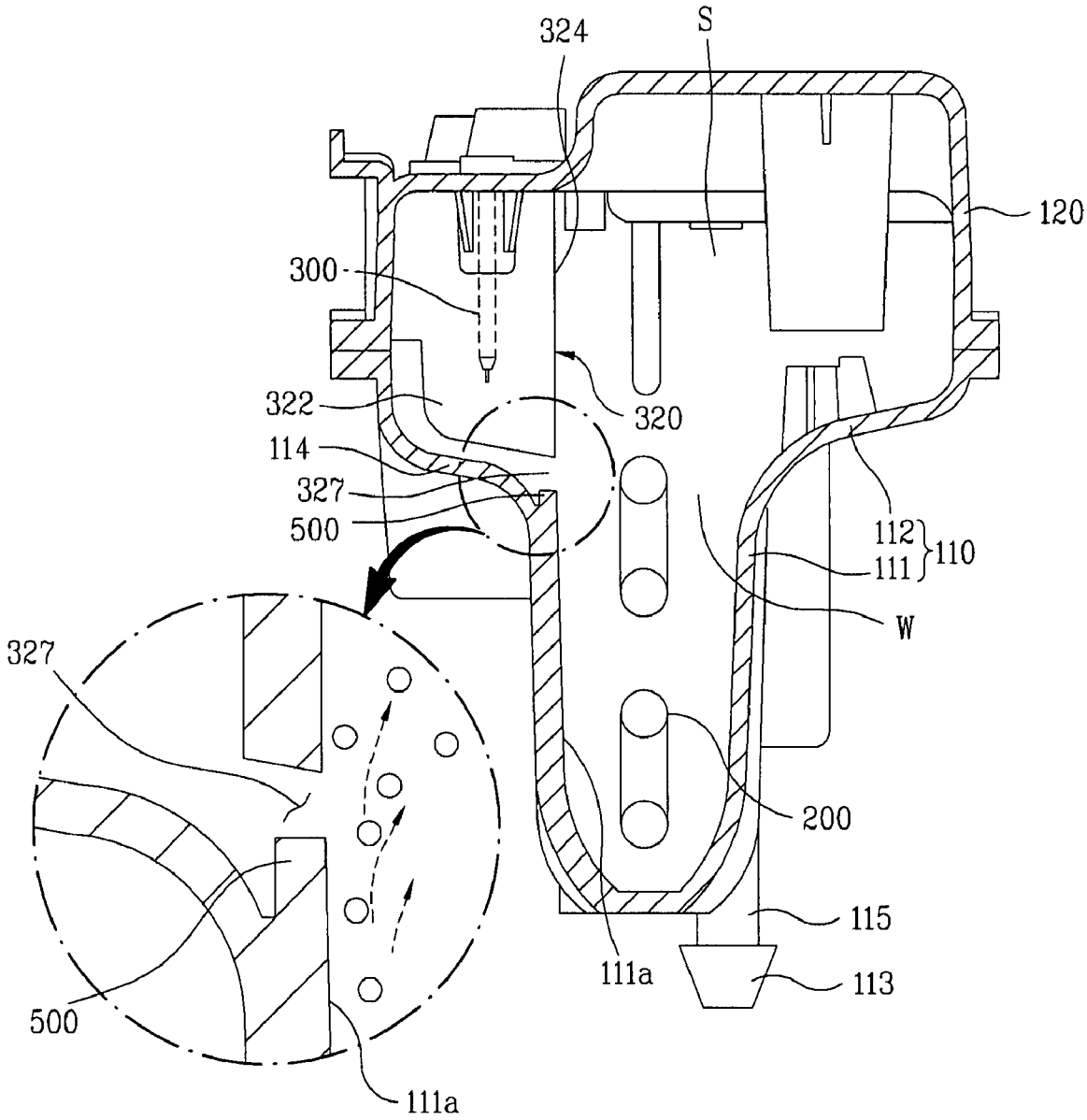
FIG. 8 is a sectional view corresponding to FIG. 6.

FIG. 5 is a schematic view for explaining the principle of a steam generating device according to the present invention. FIG. 5 corresponds to FIG. 4. FIG. 6 is a perspective view illustrating a concrete embodiment of the steam generating device shown in FIG. 5. FIG. 7 is a bottom view illustrating an upper housing shown in FIG. 6. FIG. 8 is a sectional view corresponding to FIG. 6.

Figure 9:
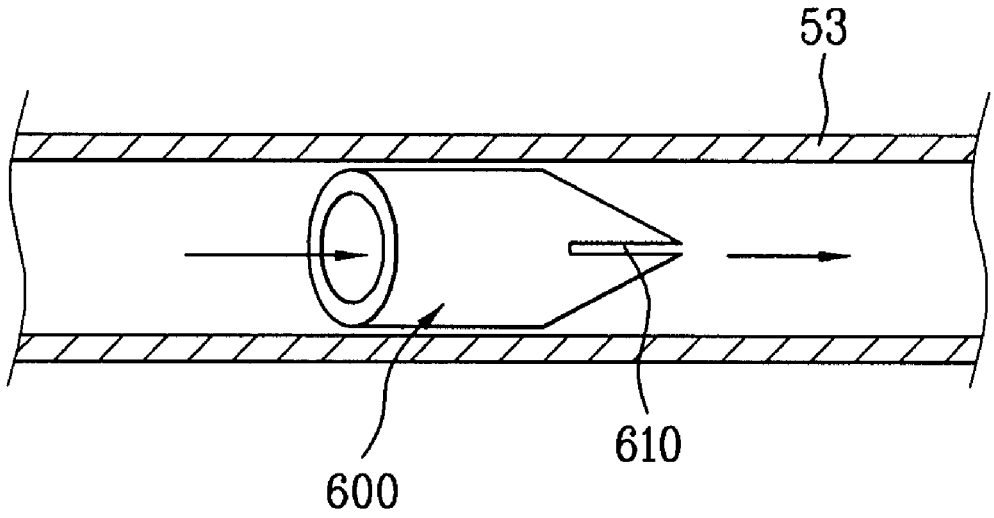
FIG. 9 is a schematic view illustrating an installed state of an inverse flow preventing member according to the present invention.
Figure 10:
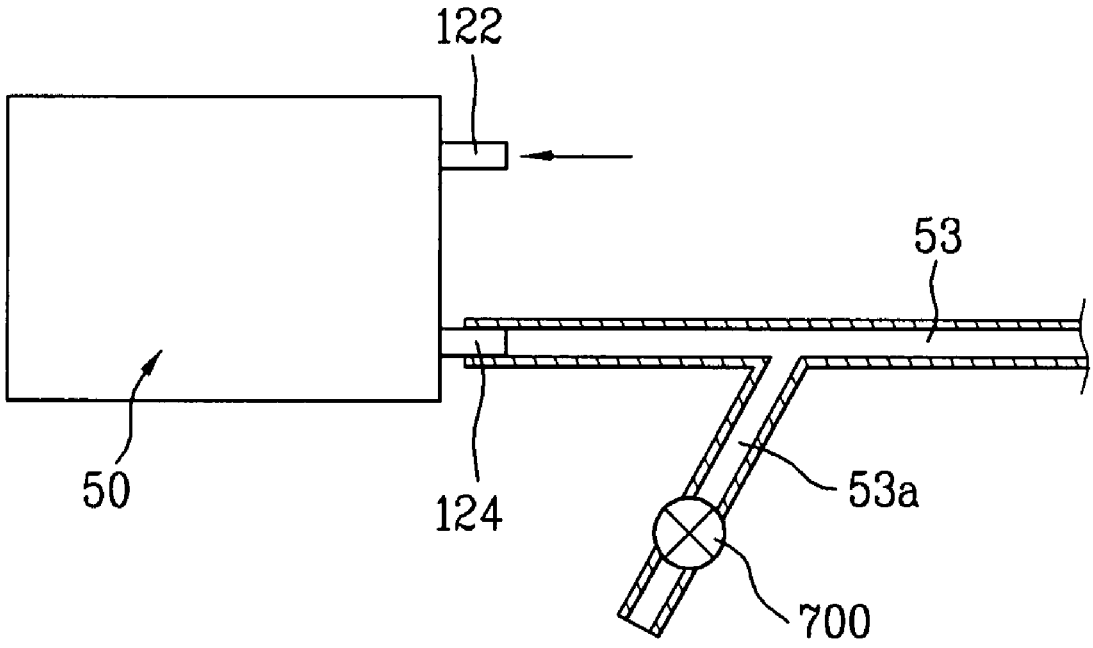
FIG. 10 is a schematic view illustrating an installed state of a safety valve according to the present invention.

FIG. 9 is a schematic view illustrating an installed state of an inverse flow preventing member according to the present invention. FIG. 10 is a schematic view illustrating an installed state of a safety valve according to the present invention.

Hereinafter, the principle of the steam generating device according to the present invention will be described with reference to FIG. 5.

The steam generating device 100 according to the illustrated embodiment of the present invention includes a lower housing defined with a water chamber W, in which a heater 200 for heating water is installed. The steam generating device 100 also includes an upper housing defined with a steam chamber S arranged over the water chamber W. The steam chamber S contains steam generated in accordance with the heating of water.

Water contained in the water chamber W is heated by the heater 200, thereby generating steam. The generated steam is temporarily contained in the steam chamber S, and is then outwardly discharged from the steam chamber S through a steam discharge port formed at the steam chamber S.

In the conventional steam generating device 50, as shown in FIG. 4, the water chamber W has a vertical length L3 relatively shorter than a horizontal length L2 because the steam generating device 50 has a rectangular shape.

That is, in the conventional steam generating device 50, the heater 55 is horizontally arranged, and the vertical length L3 of the water chamber W is only about the thickness of the heater 55. In the conventional case, accordingly, the steam generating device 50 has an increased horizontal length to satisfy a required amount of water in the steam generating device 50.

On the other hand, in accordance with the present invention, the water chamber W has a vertical length L4 substantially longer than a horizontal length L5.

Accordingly, the heater 200 extends substantially in a vertical direction in the water chamber W. As shown in FIG. 5, the vertical length of the water chamber W may substantially correspond to a length L4*a*, namely, the vertical extension length of the heater 200. However, since it is preferred that water be contained in the water chamber W to a level higher than the top of the heater 200, it is assumed, in the following description, that the vertical length of the water chamber W corresponds to "L4". However, there is no contradiction or problem caused by this assumption because the difference between "L4" and "L4*a*" is relatively small, and the amount of water contained in the water chamber W to the level L4*a* is a main portion of the total amount of water contained in the water chamber W. For the same reason, it is also assumed that the horizontal length of the water chamber W corresponds to the width of a portion of the water chamber W, in which the main portion of the total water amount is contained, namely, "L5".

Hereinafter, the advantages of the steam generating device 100 according to the illustrated embodiment of the present invention will be described.

It is possible to reduce the horizontal length L5 of the water chamber W, as compared to conventional cases, while containing the same amount of water. Accordingly, it is possible to reduce the interference between the tub 20 and the steam generating device 100. Through an experiment, it was found that, in the steam generating device 100 according to an exemplary embodiment of the present invention, it is possible to reduce the amount of water used to generate the same amount of steam as the conventional cases, and the steam generating time, and thus to reduce the size of the steam generating device 100.

Meanwhile, it is preferred that the horizontal length L6 of the steam chamber S be relatively longer than the horizontal length L5 of the water chamber W. That is, although it is possible to reduce the horizontal length L6 of the steam chamber S, as compared to the conventional cases, it is preferred that the horizontal length L6 of the steam chamber S be equal to or slightly shorter than those of the conventional cases. This is because a water supply port and a steam discharge port are typically formed at the steam chamber S, and a water level sensor, a temperature sensor, etc. are also mounted to the steam chamber S.

When the vertical length L4 of the water chamber W is relatively longer than the horizontal length L5, as described above, it is also preferred that the water chamber W be arranged substantially at a central portion of the steam chamber S, as shown in FIG. 5.

Hereinafter, a concrete embodiment of the steam generating device 100 shown in FIG. 5 will be described with reference to FIG. 6.

The steam generating device 100 includes a lower housing 110 and an upper housing 120. The upper housing 120 has a horizontal length longer than the horizontal length of the lower housing 110. The lower housing 110 includes a portion in which the heater 200 is mounted, which contains a main portion of the total amount of water in the water chamber W, and which has a vertical length longer than a horizontal length. This portion will be referred to as a "main portion 111", for the convenience of description (FIG. 8). The lower housing 110 also includes portions extending from the main portion 111 in opposite lateral directions, and connected to the upper housing 120. These portions will be referred to as "connecting portions 112 and 114", for the convenience of description (FIG. 8). It is preferred that the main portion of water in the water chamber W be present in the main portion 111 of the lower housing 110, and the remaining small portion of water in the water chamber W be present in the connecting portions 112 and 114. It is also preferred that the connecting portions 112 and 114 be inclined toward the main portion 111. In accordance with this structure, it is possible to prevent foreign matter such as lime from being deposited over electrodes of a water level sensor arranged in the connecting portions 112 and 114.

Since the pressure and temperature of steam generated in the water chamber W are relatively high, as compared to conventional cases, it is preferred that the lower and upper housings 110 and 120 be made of a material capable of withstanding high pressure and temperature. In this regard, it is preferred that the lower and upper housings 110 and 120 be connected using vibration fusing, rather than thermal fusing.

Hereinafter, the upper housing 120 defined with the steam chamber S will be described with reference to FIGS. 7 to 9.

A water supply port 122 and a steam discharge port 124 are formed at the upper housing 120. Preferably, the housing 120 has a protruded portion, to form the water supply port 122 and steam discharge port 124 at the protruded portion.

A water level sensor 300 and a temperature sensor 400 are arranged in the upper housing 120. The water level sensor 300 is arranged at a position spaced apart from the water supply port 122 by a certain distance. It is preferred that the water level sensor 300 be arranged at a position misaligned from a water supply direction of the water supply port 122.

In this case, it is possible to prevent water splashed while being discharged from the water supply port 122 from coming into contact with the water level sensor 300, and thus to prevent the water level sensor 300 from malfunctioning.

It is also preferred that the water level sensor 300 be arranged adjacent to an inner wall surface of the upper housing 120, namely, be arranged over the connecting portion 114 of the lower housing 110, rather than the main portion 111. In other words, it is preferred that the water level sensor 300 be arranged to be spaced apart from the main portion 111 of the water chamber W by a certain distance.

In this case, it is possible to effectively prevent water splashed and air bubbles generated during a heating operation of the heater 200, in particular, in an initial heating stage of the heater 200 from coming into direct contact with the water level sensor 300, and thus to effectively prevent the water level sensor 300 from malfunctioning due to the splashed water and air bubbles.

The steam generating device 100 according to the illustrated embodiment of the present invention includes a receptacle 320 for protecting the water level sensor 300. The receptacle 320 is arranged in the upper housing 120 such that the outer surface of one side wall of the receptacle 320 arranged toward the center of the upper housing 129 is substantially aligned with an inner surface 111*a* of the main portion 111 of the lower housing 110, or is arranged outside the inner surface 111*a* with respect to the heater 200.

In this case, it is preferred that a rib 500 be provided at the inner surface 111*a* of the main portion 111, to prevent air bubbles from flowing into the receptacle 320.

It is also preferred that the rib 500 be integrally formed at the inner surface 111*a* of the main portion 111, and be protruded toward an opening formed at the bottom of the receptacle 320.

When the outer surface of one side wall of the receptacle 320 is arranged outside the inner surface 111*a* of the main portion 111, and the rib 500 is provided, as described above, it is possible to prevent air bubbles generated during a water heating operation of the heater 200 from flowing into the receptacle 320.

Hereinafter, the structure for preventing air bubbles from flowing into the receptacle 320 will be described in more detail.

The receptacle 320 according to the illustrated embodiment of the present invention may include barrier walls.

The barrier walls may be formed separately from the steam generating device 100, as in conventional cases. However, it is preferred that the inner wall of the upper housing 120 constitutes a part of the barrier walls of the receptacle 320.

That is, the barrier walls of the receptacle 320 may include a long barrier wall 324 arranged in parallel to the water level sensor 300, to form a longitudinal surface of the receptacle 320, and a pair of short barrier walls 322 each connected, at one end thereof, to the long barrier wall 324, and connected, at the other end thereof, to the inner wall surface of the upper housing 120 such that the short barrier walls 322 form opposite lateral surfaces of the receptacle 320, respectively.

Preferably, the long barrier wall 324 is arranged over the connecting portion 114 of the lower housing 110. In particular, it is preferred that the long barrier wall 324 be arranged over the rib 500 extending upwardly from the main portion 111 of the water chamber W.

The first short barrier wall 322 may be arranged at one side of the heater 200, whereas the second short barrier wall 323 may be arranged at the other side of the heater 200.

In order to allow water to be introduced into the receptacle 320, it is preferred that a first opening 327 be formed at a lower end of the long barrier wall 324, and second openings 326 be formed at the other-side ends of the short barrier walls 322.

In order to prevent air bubbles from being introduced inside the long barrier wall 324, and thus into the receptacle 320, it is preferred that the long barrier wall 324 be substantially aligned with the inner surface 111*a* of the main portion 111, or be arranged at a position spaced apart from the heater 200 by a longer distance than that of the inner surface 111*a*. It is also preferred that the rib 500 be provided at the inner surface 111*a* of the main portion 111, to prevent air bubbles from flowing inside the long barrier wall 324.

In this case, it is preferred that the rib 500 be integrally formed with the inner surface 111*a* of the main portion 111 while being protruded toward the first opening 327.

When the outer surface of the long barrier wall 324 is arranged at a position spaced apart from the heater 200 by a longer distance than that of the inner surface 111*a* of the main portion 111, and the rib 500 is protruded toward the first opening 327, as described above, it is possible to guide air bubbles generated in the water chamber W by the heater to flow outside the receptacle 320, namely, outside the long barrier wall 324.

Accordingly, it is possible to prevent air bubbles from being introduced into the receptacle 320, and thus to prevent the water level sensor 300 from malfunctioning due to air bubbles.

Meanwhile, the water level sensor 300 includes a common electrode 312, a low-water-level electrode 314, and a high-water-level electrode 316. The high-water-level electrode 316 is spaced apart from the low-water-level electrode 314 by a certain distance.

For the water level sensor 300, a standard product, which includes a common electrode 312, a low-water-level electrode 314, and a high-water-level electrode 316*a*, is commercially available. Accordingly, a general water level sensor assembly, which has such a configuration, may be used in the present invention, without any modification. In this case, however, it is preferred that a separate high-water-level electrode 316 be used, in place of the high-water-level electrode 316*a* of the general water level sensor assembly.

In this case, a high-water-level electrode receiver 318 is provided at a position spaced apart from the water level sensor 300, to receive the high-water-level electrode 316. Preferably, the high-water-level electrode receiver 318 has a cylindrical barrier wall structure. In accordance with the provision of the high-water-level electrode receiver 318, it is possible to prevent the water level sensor 300 from malfunctioning due to water drops attached between the low-water-level electrode 314 and the high-water-level electrode 316.

As described above, the steam discharge port 124 is formed at the upper housing 120, to discharge steam. A separator 420 is arranged at the steam discharge port 124, in order to separate the region, through which steam is outwardly discharged, from other regions.

Water and air bubbles are severely splashed when the water is heated in the water chamber W, in particular, in an initial heating stage. The separator 420 prevents the splashed water from being introduced into the drum through the steam discharge port 124. When the splashed water is introduced into the drum, spots may be formed on the laundry. The separator 420 avoids such a phenomenon.

The separator 420 may have various structures, as long as it has a hole communicating with the steam discharge port 124 therein, to receive steam from the steam discharge port 124. Preferably, the separator 420 has a barrier wall structure. In this case, it is preferred that the barrier wall structure has openings 421 to receive steam.

Although there is no limitation on the shape of the openings 421, it is preferred that the openings 421 be arranged in a longer-axis direction. It is also preferred that the openings 421 be spaced apart from the steam discharge port 124 by a certain distance.

The barrier wall structure includes a first barrier wall 424 substantially facing the steam discharge port 124, and a second barrier wall 422 extending from an inner surface of the upper housing 120 toward the first barrier wall 424. Although the first and second barrier walls 424 and 422 may be integrally formed, it is preferred that the barrier wall structure includes one first barrier wall 424 and a pair of second barrier walls 422 separated from the first barrier wall 424 such that an opening 421 is defined between the first barrier wall 424 and each second barrier wall 422. In this case, it is also preferred that the first barrier wall 424 be arranged over the connecting portion 112 of the water chamber W, rather than the main portion 111 of the water chamber W.

An auxiliary separator 430, for example, a barrier wall, may be arranged outside the separator 420. Preferably, the barrier wall of the auxiliary separator 430 is arranged adjacent to the openings 421 of the separator 420. Also, It is preferred that the barrier wall of the auxiliary separator 430 do not come into contact with the inner wall surface of the steam generating device 100.

Meanwhile, water is supplied to the water chamber W via a water supply line including, for example, the water supply hose or water supply port 122. Steam from the steam chamber S is discharged into the drum via a steam discharge line including, for example, the steam discharge port 124 and steam hose.

Preferably, a reverse flow preventing member is arranged in at least one of the water supply line and steam discharge line, to prevent water and steam from flowing reversely.

For the reverse flow preventing member, various members may be used, as long as they have a reverse flow preventing function. For example, a one-way valve may be used for the reverse flow preventing member. However, it is preferred that, for the reverse flow preventing member, a nozzle-shaped flexible member 600 be used, as shown in FIG. 9, because the reverse flow preventing member is arranged in the water supply hose, water supply port 122, water discharge port 124, or steam discharge hose, which has a relatively-small diameter. A slit 610 is formed at a nozzle portion of the flexible member 600.

Meanwhile, as shown in FIG. 10, a safety valve 700 is preferably arranged at a certain position of the steam discharge line. The safety valve 700 is automatically opened when the pressure of steam passing through the steam discharge line is higher than a predetermined level. The steam hose, which is designated by reference numeral "53" in FIG. 10, may be branched to form a branch pipe 53*a*, and the safety valve 700 may be arranged in the branch pipe 53*a*.

When no steam is supplied to the drum due to a problem occurring in the steam supply line, an excessive pressure is applied to the steam supply line. In this case, the safety valve 700 is automatically opened to outwardly discharge steam from the steam supply line.

A draining member 115 is provided at the water chamber W, as shown in FIG. 8, to outwardly drain water from the water chamber W. An opening/closing member 113 is arranged at the draining member 115, to open or close the draining member 115. When the opening/closing member 113 is opened, water from the water chamber W can be outwardly discharged. As the steam generating device 100 is continuously used for a prolonged period of time, foreign matter such as lime is accumulated in the steam generating device 100. In this case, the draining member 115 is opened to outwardly drain water from the water chamber W, and thus to discharge the accumulated foreign matter, together with the water. Accordingly, it is possible to avoid the accumulation of foreign matter.

The opening/closing member 113 may be a drain cap which can be manually opened or closed by the user or operator. Alternatively, the opening/closing member 113 is configured to be automatically opened or closed. For example, a solenoid valve may be used. Also, the opening/closing member 113 may be configured using a siphon principle.

Although the present invention has been described in conjunction with the steam generating device according to an exemplary embodiment of the present invention, the present invention is not limited thereto. It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The steam generating device having the above-described configuration according to the present invention and the washing machine having the same provide the following effects.

First, it is possible to more easily install the steam generating device because the water chamber of the steam generating device has a vertical length shorter than a horizontal length.

Second, it is possible to enhance the performances of the steam generating device and washing machine because a desired amount of steam can be generated within a reduced time, using a reduced amount of water.

Third, it is possible to prevent air bubbles from flowing into the receptacle, and thus to efficiently prevent the water level sensor from malfunctioning because the outer surface of one side wall of the receptacle is arranged outside the inner surface of the lower housing, and a rib is provided at the inner surface of the lower housing.

Fourth, it is possible to efficient prevent water and steam from flowing inversely in accordance with the present invention. Also, there is an improvement in security because the safety valve operates when an excessive pressure is applied to the steam supply line due to a problem occurring in the steam supply line.

Fifth, in accordance with the present invention, it is possible to water from the steam generating device from being introduced into the drum, and thus to prevent spots from being formed on the laundry.

What is claimed is:

1. A washing machine or a drying machine comprising:
a body;
a drum arranged in the body, to receive laundry; and
a steam generating device including:
a water chamber to hold water, the water chamber including a main portion having a vertical length greater than a horizontal length in which a heater is placed,
a steam chamber provided above the water chamber to hold steam generated as the water is heated, the steam chamber having a horizontal direction length relatively greater than the horizontal length of the main portion of the water chamber,
the water chamber further including a connecting portion that extends radially outward to connect the water chamber to the steam chamber,
a water level sensor provided above the connecting portion to sense a level of water contained in the water chamber, and
a rib provided at an upper end of the main portion of the water chamber to prevent air bubbles from flowing into the water level sensor.

2. The machine according to claim 1, wherein the connecting portion is inclined towards the main portion of the water chamber.

3. The machine according to claim 1, wherein the rib protrudes upward from the upper end of the main portion and separate from the connecting portion.

4. The machine according to claim 1, wherein the rib protrudes from an inner surface of the main portion of the water chamber.

5. The machine according to claim 1, further comprising a wall protecting the water sensor, wherein the wall extends downward from the steam chamber.

6. The machine according to claim 5, wherein the wall is spaced apart from the heater by a distance equal to or greater than a distance from the heater to an inner surface of the main portion of the water chamber.

7. The machine according to claim 5, wherein an arrangement of the rib and the wall provides an opening there between.

8. The machine according to claim 5, wherein the wall comprises:
a pair of short barrier walls each having a first end connected to the wall and a second end connected to an inner wall surface of the steam chamber, wherein the wall is arranged substantially parallel to the water level sensor.

9. The machine according to claim 8, wherein a first opening is formed at a lower end of the wall, and a second opening is formed at one side of each short barrier wall.

10. The machine according to claim 1, wherein the connection portion connects the water chamber to ends of the horizontal direction length of the steam chamber.

11. A washing machine or a drying machine comprising:
a body;
a drum arranged in the body, to receive laundry; and
a steam generating device including:
a water chamber to hold water, the water chamber including a main portion having a vertical length greater than a horizontal length in which a heater is placed,
a steam chamber provided above the water chamber to hold steam generated as the water is heated, the steam chamber having a horizontal direction length relatively greater than the horizontal length of the main portion of the water chamber,
the water chamber further including a connecting portion that extends radially outward to connect the water chamber to the steam chamber,
a water level sensor provided above the connecting portion to sense a level of water contained in the water chamber,
a receptacle protecting the water level sensor, wherein the receptacle is spaced apart laterally from the heater by a distance equal to or greater than a distance from the heater to a side inner surface of the main portion, and
a rib provided at an upper end of the main portion of the water chamber to prevent air bubbles from flowing into the water level sensor.

12. The machine according to claim 11, wherein the connecting portion is inclined towards the main portion of the water chamber.

13. The machine according to claim 11, wherein the receptacle includes a barrier wall.

14. The machine according to claim 13, wherein the barrier wall of the receptacle includes an inner wall surface of the steam chamber.

15. The machine according to claim 11, wherein the receptacle extends downwardly from the steam chamber.

16. The machine according to claim 15, wherein the receptacle includes:
a long barrier wall arranged substantially parallel to the water level sensor; and
a pair of short barrier walls each having a first end connected to the long barrier wall and a second end connected to an inner wall surface of the steam chamber.

17. The machine according to claim 16, wherein an opening is formed between a lower end of the long barrier wall and an upper end of the main portion of the water chamber.

18. The machine according to claim 16, wherein the long barrier wall aligns or substantially aligns with an upper end of the main portion of the water chamber.

19. The machine according to claim 18, wherein the rib protrudes towards the lower end of the long barrier wall of the receptacle.

20. The machine according to claim 16, wherein an opening is formed between the lower end of the short barriers and the connecting portion.

21. The machine according to claim 11, wherein the connection portion connects the water chamber to ends of the horizontal direction length of the steam chamber.

* * * * *